United States Patent [19]

Fetcenko et al.

[11] Patent Number: 4,729,513

[45] Date of Patent: Mar. 8, 1988

[54] LANCE EXTENSION VENTURI SLEEVE

[75] Inventors: Raymond M. Fetcenko, Elyria; Thomas E. Hollstein, Amherst, both of Ohio

[73] Assignee: Nordson Corporation, Westlake, Ohio

[21] Appl. No.: 918,542

[22] Filed: Oct. 10, 1986

Related U.S. Application Data

[63] Continuation of Ser. No. 638,391, Aug. 3, 1984, abandoned.

[51] Int. Cl.[4] ..... B05B 5/02

[52] U.S. Cl. ..... 239/707; 239/708; 406/194; 406/195

[58] Field of Search ..... 406/194, 195; 239/432, 239/704–708, 690, 427

[56] References Cited

U.S. PATENT DOCUMENTS

| | | | |
|---|---|---|---|
| 2,992,194 | 7/1961 | Paulsen | 239/427 X |
| 3,503,650 | 3/1970 | Balmes, Sr. . | |
| 3,746,255 | 7/1973 | Duncan et al. . | |
| 3,870,375 | 3/1975 | Duncan et al. . | |
| 3,918,647 | 11/1975 | Lamz et al. | 239/432 X |
| 3,960,323 | 6/1976 | Duncan et al. . | |
| 4,037,561 | 7/1977 | LaFave et al. . | |
| 4,109,861 | 8/1978 | McHugh | 239/707 |
| 4,116,384 | 9/1978 | Lacchia . | |
| 4,169,560 | 10/1979 | Vohringer . | |
| 4,258,409 | 3/1981 | Porter . | |
| 4,380,320 | 4/1983 | Hollstein et al. . | |

FOREIGN PATENT DOCUMENTS

| | | | |
|---|---|---|---|
| 2519273 | 7/1973 | France | 239/590 |
| 2229206 | 12/1974 | France | 239/707 |

*Primary Examiner*—Andres Kashnikow

*Attorney, Agent, or Firm*—Wood, Herron & Evans

[57] ABSTRACT

A lance extension venturi sleeve is disposed preferably within the rear one-third of the lance extension of a powder spray gun. The sleeve increases the velocity of the powder stream and provides an abrupt opening to the larger lance extension tube. The velocity increase and the turbulence so created increase the homogeneity of the powder in the stream and produce a more uniform powder spray pattern or powder "cloud" for even powder coating of articles to be coated.

4 Claims, 2 Drawing Figures

LANCE EXTENSION VENTURI SLEEVE

Figure 1:
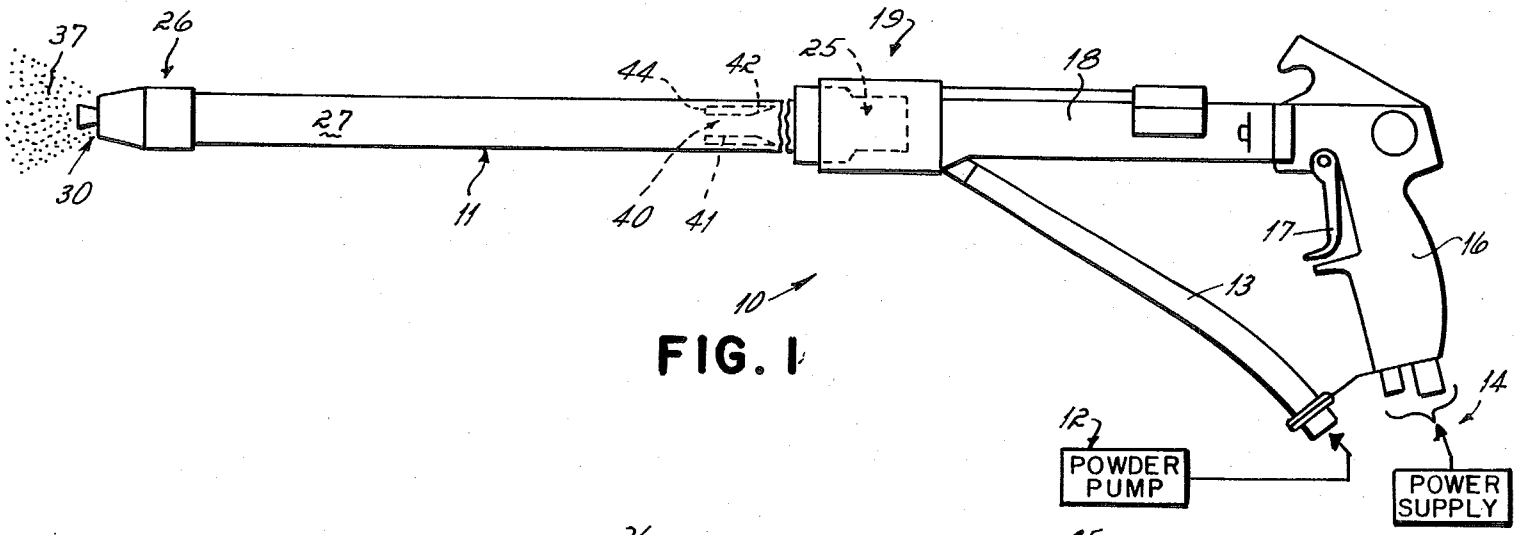

This is a continuation of application Ser. No. 638,391, filed Aug. 3, 1984, now abandoned.

This invention relates to the spraying of powder and, more particularly, to an apparatus for improving the homogeneity of the sprayed powder pattern.

In the application of powder coating material to objects in industrial finishing processes, a powder material such as an epoxy, polyester, or porcelain frit is conveyed to an applicator gun by air under pressure, is dispensed from the gun in the form of a cloud or spray pattern, and is projected toward the object to be coated in particulate form. As the coating material is dispensed from the gun, the particles are electrically charged so that they will be electrostatically attracted toward the grounded object to be coated. After coating, the object is moved into an oven where the powder coating material is baked onto the surface. The material being dispensed from the gun is in particulate form and it is necessary to direct the material in a uniform spray pattern to obtain uniform smooth coverage of the surface to be coated.

Certain applications present certain obscured surfaces for powder coating, which surfaces are difficult to reach with normal powder spray guns. For example, the interior surfaces of certain structures are often difficult to spray with the normal spray gun and nozzle unit due to their size or shape. In such applications, a lance extension is used in place of the regular spray nozzle of the gun. These lance extensions are essentially elongated tubes having spray nozzles of their own at a far end spaced away from the gun. The lance extension is secured to the gun in place of the regular nozzle, and powder is conveyed by air under pressure through the tube to the end of the lance. There, the powder is dispensed by the lance nozzle in the form of a spray and projected onto the surface to be coated at a position which the gun and normal nozzle may not have been able to reach.

While the use of a lance extension has solved certain difficult application problems, the lance extension produces several inherent problems of its own. For example, in powder coating applications, it is necessary to produce a homogeneous or uniform powder spray. That is to say, it is necessary that the powder spray pattern be of uniform powder density. If it is not, then a surface to be coated receives a non-uniform powder application, resulting in a non-uniform coating.

It is difficult to maintain a homogeneous mix of powder and conveying air in the lance extension. When a moving air stream is used to convey powder, the powder tends to fall out of suspension in the stream such that in a cross-section of a lance extension tube at any particular time, more powder may be concentrated in the bottom area of the cross section (or tube) than in the top. This produces, once the powder is dispensed at the extension nozzle, an uneven, non-uniform spray pattern which may result in an uneven surface coating.

Also, it is possible for powder to accumulate at the bottom of the tube, be pushed along, and "dribble" out of the nozzle at the bottom of the spray pattern or cloud. This can produce highly uneven powder coatings.

This problem is compounded by the fact that in normal equipment installations, the powder is conveyed to the gun through 10 or 20 feet of hose. These lengths provide time in which the conveyed powder may fall out of suspension in the air stream or densify or collect at the lower portions of the moving air column, and thus produce non-uniform spray patterns when eventually dispensed. This problem is, of course, inherent in a normal gun/nozzle unit, but it is compounded when a lance extension is used, which requires the powder to be conveyed over a still longer distance.

Accordingly, it has been one objective of this invention to provide apparatus for improving the uniformity of distribution of powder conveyed by moving fluid within that fluid.

A further objective of the invention has been to provide apparatus for improving the homogeneity of a sprayed powder pattern generated through a lance extension of a powder spray gun.

A further objective has been to provide improved apparatus for producing a uniform powder density in powder patterns sprayed by a nozzle.

To these ends, a preferred embodiment of the invention includes a powder venturi sleeve disposed at the rear end of a lance extension, preferably about one-third the distance from the rear end of the extension to a forward end thereof. The sleeve has a rearwardly opening, conically-shaped, tapered surface leading into a bore of reduced internal diameter, as compared to the internal diameter of the lance extension therearound. The forward end surface of the sleeve is preferably flat, in a radial direction, and is perpendicular to the bore therethrough. This provides an abrupt opening from the reduced bore of the sleeve into the enlarged bore of the lance extension tube.

The venturi effect created on the powder stream by the sleeve, together with the abrupt downstream opening of the sleeve bore into the lance extension, increases the velocity of the powder and creates turbulence in the powder stream. The powder stream is thus subjected to increased velocity and turbulence which mixes the powder in the stream, and produces a homogeneous powder stream resulting in a uniform powder spray pattern or "cloud" when the powder is dispensed from the lance extension through the nozzle. Powder which may have fallen from suspension in the air stream, including powder otherwise accumulated on bottom surfaces of the powder feed passages or lance extension tube, is picked up and recaptured as part of the homogeneous powder stream.

Since the venturi sleeve is disposed nearer the rear end of the lance extension tube, about two-thirds of the entire lance extension length is left downstream of the sleeve. This permits the powder and air stream to settle down somewhat from the turbulence caused by the venturi sleeve, yet not enough for any significant powder to drop out of the stream nor accumulate on bottom surfaces of the lance extension bore forward of the venturi sleeve.

In this regard, it will be appreciated that powder is usually conveyed from a supply to the gun through 10 to 20 feet of hose, and that the distance from the venturi sleeve to the forward end of the lance extension is a small fraction of the entire length of the overall powder delivery system. Accordingly, the venturi sleeve according to a preferred embodiment of the invention is effectively disposed at a forward end of the powder delivery system, even though it is spaced away from the extreme forward end of the lance extension.

Of course, it will be appreciated that the venturi sleeve can be disposed at certain positions along the path of the powder stream to increase powder homogeneity of the stream as desired. For example, and without limitation, it is believed to be useful to dispose the venturi sleeve at the nozzle of a regular powder spray gun in order to increase uniformity of the powder spray pattern.

Figure 2:
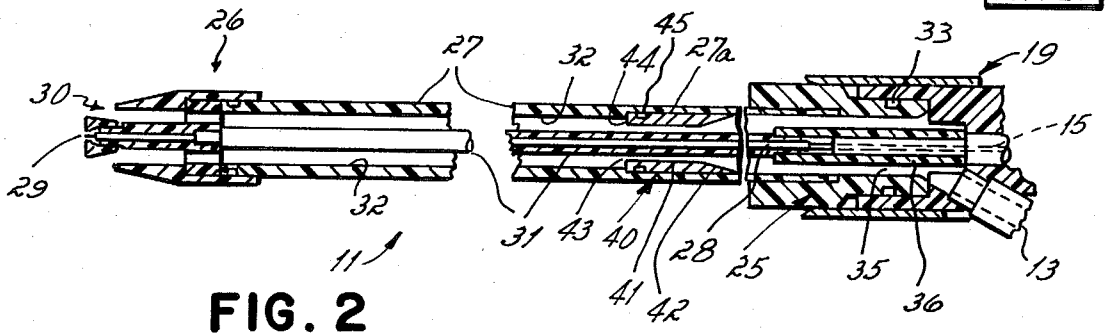

These and other objectives and advantages will become even more readily apparent from the following detailed description of a preferred embodiment of the invention, and from the drawings in which:

FIG. 1 is an elevational view of a powder gun, operably connected to a lance extension provided with a venturi sleeve according to the invention; and FIG. 2 is an axial-cross sectional view through the forward end of the gun and the lance extension of FIG. 1.

Turning now to the drawings, there is shown in FIG. 1 thereof an elevational view of a powder spray gun 10 in association with a lance extension 11, comprising a preferred embodiment of the invention. It will be appreciated that the powder gun 10 is connected to a powder pump 12, or other suitable means for blowing powder in a powder stream through a tube 13 to the gun 10. Preferably, the powder pump creates a pressurized air stream which picks up and conveys the powder. The powder pump 12 by itself comprises no part of the present invention. Exemplary apparatus for blowing powder through the tube 13 is disclosed in prior patents such as U.S. Pat. Nos. 3,746,254; 3,870,375; and 3,960,323, incorporated herein by reference for background disclosure purposes.

Gun 10 is also provided with appropriate connections 14 for connecting an electrode 15 within the gun to an appropriate source of power for the purpose of charging powder particles once they are dispensed from the gun.

As noted, the gun generally includes a handle 16, a trigger means 17 and a gun barrel 18, terminating in a forward end 19 which is operatively connected to the tube 13 for receiving the stream of powder. Of course, the invention is also applicable to an "automatic gun" which is fixed to a support rather than being hand-held.

The lance extension 11 includes a rearward end 25, a forward end 26, and a lance extension tube 27. As shown in FIG. 2, the lance extension further comprises an electrode 28 extending forwardly of the electrode 15, and operatively connected thereto, for the purpose of charging particles at the forward end 26 of the lance extension 11 as the particles are dispensed from the nozzle 30 of the lance extension. The electrode 28 has a forward end 29 for this purpose. The electrode 28 is surrounded by an insulating sleeve 31 residing within internal, cylindrically shaped surface 32 of lance extension tube 27.

As shown in FIG. 2, the rearward end 25 of the lance extension 11 is mounted into and sealed to the forward end 19 of the gun 10. The lance extension may be slip fitted into the forward end of the gun and sealed by means of the O-ring 33.

When the gun is energized and is operated to dispense powder, powder is conveyed in a stream through the tube 13 (FIG. 2) to the forward end 19 of the gun. Powder is then blown into the annular space 35 defined between the internal surfaces of the rearward end 25 of the lance extension and a connector sleeve 36 serving to connect the electrodes 15 with the electrode 28. From there, the powder enters the tube 27 and is blown therealong to the forward end 26 of the gun, where the powder is dispensed through the nozzle 30 in a powder pattern or "cloud" 37 (FIG. 1).

As previously described, it is highly desirable to produce a very uniform powder pattern so that the object to be coated will be evenly coated with no variations of powder thicknesses deposited thereon. Should the powder fall out of suspension within the powder stream, it tends to lie in the bottom surfaces of the tubes 13 and 27 and thus either dribble out of the forward end 26 of the lance extension or be concentrated in the lower portion of the powder pattern, thereby depositing an uneven coating of powder on the object or article to be coated.

In order to increase the uniformity of the powder mix within the powder stream, and thus the homogeneity of the powder within the stream and in the resulting powder spray pattern 37, a preferred embodiment of the invention includes a venturi sleeve 40 disposed within a bored out area **27*a* in the tube 27. Accordingly, the venturi sleeve 40 is disposed within the internal passageway of the tube 27** and within the powder stream blown along or through the tube.

The venturi sleeve 40 includes a downstream bore 41 of constant diameter, and a conically-shaped, rearwardly opening, tapered bore 42, operatively connected with the downstream bore 41. Downstream bore 41 terminates at a port 43 at the downstream end of the sleeve 40. Port 43 must, of course, be larger in diameter than the insulating sleeve 31. The downstream end of the sleeve 40 comprises a flat radial face 44, surrounding the port 43, and extending in a radial distance perpendicularly to the internal surfaces of the tube 27. Thus, the bore 41 terminates abruptly and opens abruptly, into the larger diameter passageway defined by the internal surfaces 32 of the tube 27. An O-ring 45 seals the sleeve 40 against bored out area **27*a* and frictionally secures the sleeve 40 in tube 27**.

In a preferred embodiment, the venturi sleeve itself is approximately 1½" long, with the length of the constant diameter bore 41 being about ⅜" and the tapered bore taking up the remainder of the overall length of the sleeve. In addition, the internal diameter of the venturi sleeve at bore 41 is approximately 0.406" in diameter, although this may vary according to a particular application. The inside surface 32 of the lance tube is of a larger diameter, up to about 0.812". The outside diameter of sleeve 31 is approximately 0.275". Thus, in this embodiment, the annular cross-sectional area between the tube 27 and sleeve 31 is approximately 6.5 times greater than the annular cross-sectional area between the bore 41 and sleeve 31.

It will also be appreciated that the venturi sleeve 40 is disposed within the lance extension, closer to the rearward end 25 thereof than to the forward end 26. More particularly, it will be appreciated that the venturi sleeve 40 is spaced from the rearward end 25 of the lance extension a distance which is equal to approximately ⅓ of the overall predetermined distance between the rearward end 25 and the forward end 26 of the lance extension. Thus, while lance extensions are typically about 6" to about 24" long, in a lance extension of about 18" length, for example, the venturi sleeve 40 would be disposed within the lance tube 27 about 6" from the rearward end 25 thereof.

In this regard, it will be noted that the venturi sleeve 40 is located significantly rearwardly of the forward end 26 of the lance extension tube, as will be further discussed.

Finally, and by way of further explanation, it will be appreciated that the approximate size of a typical powder particle to be conveyed and dispensed is approximately 15 microns up to about 150 microns in size, and more particularly about 50 to 60 microns in their most common form. Moreover, it will be appreciated that the pressure system for blowing the powder stream through the tube 13 and through the gun 10 and lance extension 11 operates generally from about 1 to 2 psi, up to about 5 to 10 psi. In a typical installation, a relatively large volume of air at a relatively low pressure is utilized to convey the powder through the system.

It will also be appreciated that the powder pump 12 is normally connected to the gun 10 through the tube 13 which is typically about 10 feet to about 20 feet in length. Thus, it will be further appreciated that the lance extension 27 is disposed at the extreme forward or downstream end of the entire powder delivery system. Moreover, it will be appreciated that the venturi sleeve 40, according to the present invention, is also located at the downstream end of the entire powder delivery system, even though it is somewhat spaced from the forward end of the lance extension 11 itself.

It will also be appreciated that the internal bore 41 of the venturi sleeve 40 defines a powder stream passageway which takes on the shape of an annulus between the venturi sleeve 40 and the outer surface of the insulating sleeve 31 surrounding the electrode 28. The annular cross-sectional area of this passageway, as a result of the utilization of the venturi sleeve 40, is diminished from the annular cross sectional area defined by the tube 27 of the lance extension 11 and the sleeve 31. Thus, as the blown powder stream enters the tapered bore 42 and is conveyed through the smaller bore 41, the velocity of the stream is increased. Also, as the powder nears the downstream end of the bore 41 at the port 43, the bore 41 abruptly terminates and abruptly opens into the larger cross sectional area passageway defined by the interior surface of the tube 27 and sleeve 31. This increase in powder velocity together with the abrupt opening of the bore 41 serves to generate turbulence within the powder stream and thereby causes the powder within the lance extension to mix with itself and in the stream to provide a more homogeneous form. If any powder happens to be residing in the bottom surfaces of the tube 13 or the bottom surfaces of the forward end of the gun 10 and of the tube 27 of the lance extension, this powder is mixed into the increased velocity stream. The turbulence produced by the venturi sleeve 40 tends to further mix it so that the powder stream downstream of the venturi sleeve 40 comprises a homogeneous mixture. Thus, heavier concentrations in the lower portion of the stream, and accumulations of powder along the bottom surfaces of the tube 27 downstream of the venturi sleeve 40 are eliminated. As a result, the powder spray pattern 37 is uniformly generated and is homogeneous without undue and localized concentrations of powder within the pattern.

Also, the mixing of any powder which is accumulated in the bottom surfaces of the tube 13 or lance extension 27 eliminates any dribbling of powder out of the forward end of the lance extension so as to undesirably accumulate on the surface to be coated.

The disposition of the venturi sleeve 40 rearwardly of the forward end of the lance extension 11 permits the turbulent powder stream to settle down slightly from the turbulence created at the venturi sleeve 40. By the time the stream nears the forward end 26 of the lance extension and is actually dispensed through the nozzle 30, the stream is relatively uniform. Nevertheless, it will be appreciated that the venturi sleeve 40 is disposed close enough to the forward end of the lance extension 27 so that powder does not have an opportunity to fall out of suspension within the powder stream before being dispensed by the nozzle 30.

It will also be appreciated that by the time the powder reaches the gun 10 and tube 13, the condition of the powder within the stream is most likely at its worst in view of the length of the tube 13 from the powder pump 12. Also, in many systems where powder is conveyed, it will be appreciated that it is desirable to thoroughly mix it so as to produce a homogeneous powder stream at certain points along the system. Accordingly, and for example, it should be appreciated that the venturi sleeve 40 can be adapted to other uses apart from the specific use described here within a particular lance extension. For example, the venturi sleeve 40 could be adapted for use within the nozzle of a gun 10 which is not fitted with a lance extension 11. The venturi would provide similar results of a homogeneous powder mix within the powder stream when adapted to the nozzle area of the gun. Alternatively, of course, the venturi sleeve 40 could be adapted to other positions within a powder delivery system for the purpose of mixing the powder and providing a homogeneous powder stream.

These and other alterations and modifications will be readily appreciated by those of ordinary skill in the art, without departing from the scope of the invention, and the applicants intend to be bound only by the claims appended hereto:

We claim:

1. In a powder delivery system for spraying powder entrained in an air stream wherein the system includes a powder spray controlling gun, means for conveying an air stream entraining powder from a pump to said gun, a gun barrel integral with said gun and an elongated lance extension having a rear end operatively mounted on said forward end of said gun barrel for conveying powder from said forward end of said barrel of said powder spray gun at a rearward, upstream end of the extension to a spray nozzle spaced from said gun and disposed at a forward, downstream end of the lance extension, said extension comprising an elongated tube having a length of about 6 to about 24 inches and having an inner surface comprising an elongated internal bore of substantially constant diameter defining a path for powder blown by an air stream therethrough in a downstream direction from said gun to said nozzle, and an electrode sleeve extending through said extension and defining with said extension a powder stream flow path having a cross-sectional flow area; the improvement comprising:

venturi means for homogenizing powder within said air stream in said lance extension, said venturi means including;

an elongated venturi sleeve having upstream and downstream ends and being disposed within the upstream, rearward one-third of said lance extension tube and between forward and rearward ends of said extension;

an internal bore in said venturi sleeve defining a portion of said path and terminating at a downstream end of said sleeve within said tube;

a tapered bore in said venturi sleeve coaxial with and operatively communicating with the internal bore in said sleeve, said tapered bore extending from one diameter near said internal venturi sleeve bore to a greater diameter in an upstream direction from said internal sleeve bore;

said downstream end of said venturi sleeve comprising a flat face in a radial plane, said internal bore of said venturi sleeve terminating at a port in said face radially spaced inward from said inner surface of said extension tube and opening abruptly into said tube;

said electrode sleeve extending through said internal bore and said tapered bore in said venturi sleeve and defining therewith a powder stream flow path having a cross-sectional flow area through said venturi;

said venturi means creating increased velocity and turbulence within said path in said lance extension tube when air and powder are blown therethrough, thereby homogenizing powder within said air stream and within said lance extension tube beyond said gun barrel forward end, but upstream of said spray nozzle, and whereby said turbulence is diminished in the downstream two-thirds of said extension tube to provide a homogenized uniform powder and air stream to said nozzle for discharge therefrom in a uniform pattern.

2. A lance extension as in claim 1, wherein said electrode sleeve within said lance extension, extends through said elongated internal bore of said extension tube and through said internal bore of said venturi sleeve, and wherein the cross-sectional flow area of the powder stream flow path defined between said electrode sleeve and the inner surface of said lance extension tube is at least four times greater than the cross-sectional flow area of the powder stream flow path defined between said internal bore of said venturi sleeve and said electrode sleeve.

3. Apparatus as in claim 1, wherein said venturi sleeve is about 1.5 inches long, the downstream internal bore of said venturi sleeve is about $\frac{1}{4}$ inch to about $\frac{3}{8}$ inches long, the inside diameter of said lance extension tube bore is about 0.812 inch, and said venturi sleeve is disposed in said lance extension a distance from the rear, upstream end thereof in the approximate range of 2 inches to 8 inches.

4. A lance extension as in claim 1, wherein said lance extension includes an electrode means for charging powder particles, said electrode passing axially through said electrode sleeve in said lance extension and through said internal bore of said venturi sleeve, wherein said powder stream flow path defined between said internal bore of said venturi sleeve and said electrode sleeve is in the shape of a first annulus having a first cross-sectional flow area, and wherein said powder stream flow path defined between said inner surface of said extension tube and said electrode sleeve is in the shape of a second annulus, downstream of said first annulus, having a second cross-sectional flow area at least four times greater than that of said first annulus.

* * * * *